United States Patent [19]

Scanlon

[11] Patent Number: 4,544,163

[45] Date of Patent: Oct. 1, 1985

[54] ARROW NOCK

[76] Inventor: John P. Scanlon, 4366 Bishop, Detroit, Mich. 48224

[21] Appl. No.: 713,826

[22] Filed: Mar. 20, 1985

[51] Int. Cl.[4] ..... F41B 5/02

[52] U.S. Cl. ..... 273/416; D22/12

[58] Field of Search ..... 273/416, 419–423; D22/12

[56] References Cited

U.S. PATENT DOCUMENTS

| | | | |
|---|---|---|---|
| D. 241,636 | 9/1976 | Wood | D22/12 |
| 1,842,540 | 1/1932 | Cowdery | 273/423 |
| 2,484,589 | 10/1949 | Richards | 273/416 |
| 3,214,174 | 10/1965 | Saunders | 273/416 |
| 4,305,588 | 12/1981 | Dodge | 273/416 |

FOREIGN PATENT DOCUMENTS

| | | | |
|---|---|---|---|
| 1470802 | 4/1977 | United Kingdom | 273/416 |

*Primary Examiner*—Paul E. Shapiro

*Attorney, Agent, or Firm*—Fisher, Crampton, Groh & McGuire

[57] ABSTRACT

An arrow nock comprising a cylindrical body member having a plug shaft extending axially to one side for insertion within a tubular arrow shaft to maintain the shaft and nock in axial alignment. The nock is further provided with a grip portion which extends axially in the opposite direction from the plug shaft. The grip portion is flattened and merges with the cylindrical body member by way of an inclined surface. Disposed on opposite flat surfaces of the grip portion are pad portions facing in opposed directions and adjacent to a notch which receives the bow string. The pad portions are slightly elevated above the surface of the flattened portion. The pad portions have friction surfaces which help to grip the nock between the index and middle finger so that upon release of an arrow the incline surfaces tend to spread the finger tips and smooth surfaces adjacent to the pad portions and the recessed area at one side of the nock closest to the hand of the archer pass the fingers without engagement to minimize friction and enhance accuracy.

11 Claims, 4 Drawing Figures

ARROW NOCK

This invention relates to archery tackle and more particularly to an improved nock for arrows.

Nocks for use with arrows are old and well known in the prior art. Moreover, many attempts have been made to improve the basic design of an arrow nock so as to overcome various shortcomings inherent to the traditional design.

When utilizing the slotted nocks of the prior art, the retention of an arrow at rest or ready position on the bow string has been awkward, if not exceedingly difficult, especially for beginners because the tips of the index and middle fingers must not only draw the bow string but also hold the arrow in engaged position with the bow string. The load of the bow string alone causes pinching of the fingers and discomfort which detracts from accuracy and enjoyment of the sport of archery. Moreover, the traditional design for arrow nocks has not addressed the inherent restriction of movement of the index and middle finger across the archery nock during release of the arrow. This friction between the fingers and the nock during release results in discomfort to the user and reduced effectiveness and accuracy of the released arrow. In addition, no provision is made in the conventional arrow nocks for gripping the archery nock during the drawing procedure with the bow string whereby the operator is assured of a secure grip without an undue amount of effort or discomfort.

The present invention comprises an arrow nock having a shaft insertable into a tubular arrow shaft to insure perfect alignment between the nock and the shaft. The arrow nock of the present invention is further provided with an annular shoulder portion which abuts the arrow shaft to allow for a perfect profile of the arrow nock to the arrow shaft. The shoulder portion tapers to a flattened portion and terminates in a conventional nock to receive a bow string. The flattened portion of the arrow nock is equipped with elevated friction pads which are textured to allow the archer to hold the nock in place against the bow string and to use the nock to aid in drawing the bow string. A smooth portion is provided in close proximity to the friction portion so that upon release of the bow string the fingers clear the friction pads and the smooth portion rides past the fingers and minimizes losses due to friction. Finally, the arrow nock of the present invention is provided with a hollow portion in the nock itself so as to insure a proper distribution of weight relative to the axis of the arrow shaft.

A preferred embodiment of the invention is set forth in the following description and illustrated in the accompanying drawings in which.

Figure 1:
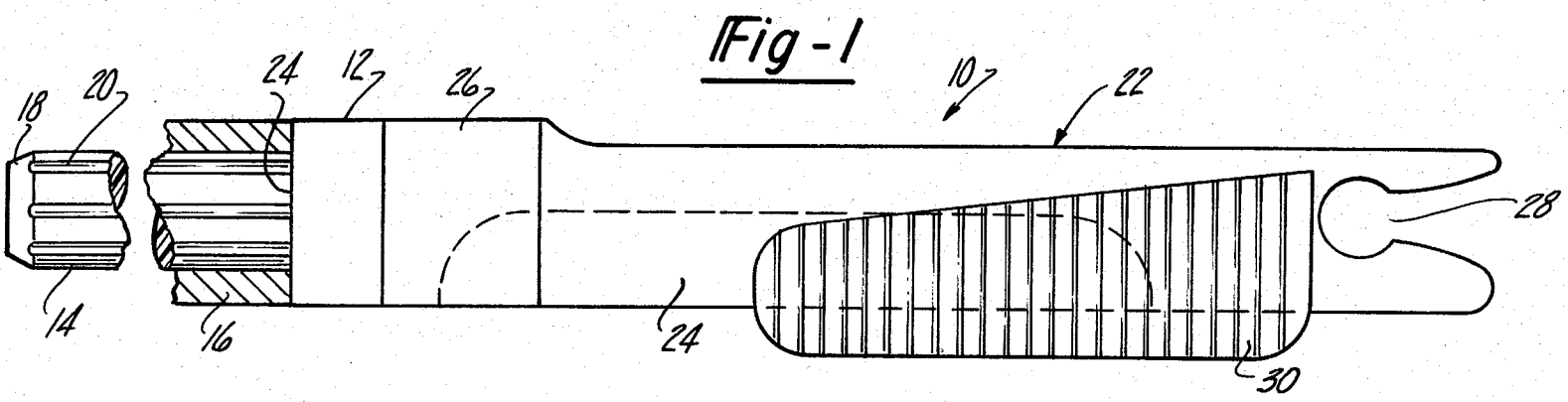
FIG. 1 is a top view of the arrow nock embodying the present invention.
Figure 2:
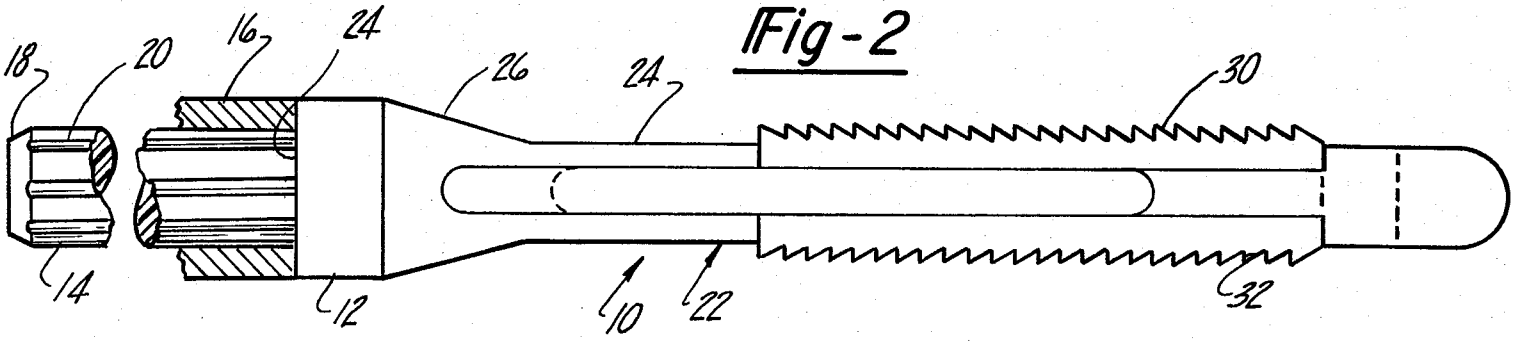
FIG. 2 is a side view of the arrow nock of FIG. 1.
Figure 4:
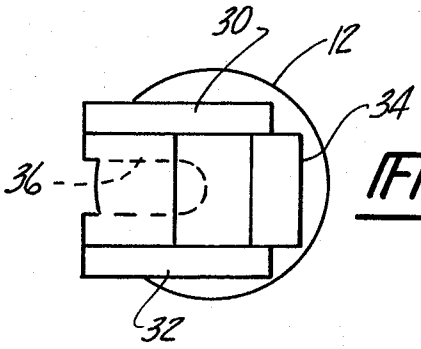
FIG. 4 is a rear view of the arrow nock of the present invention.
Figure 3:
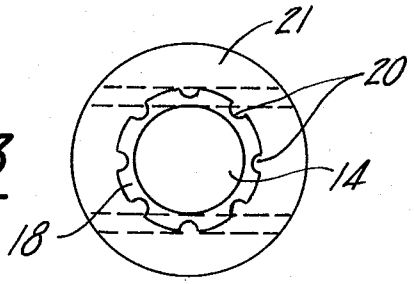
FIG. 3 is a front view of the arrow nock illustrated in FIGS. 1 and 2.

An arrow nock embodying the invention is designated generally at 10 and its major cross section is in the form of a cylindrical body member 12. A plug element or shaft 14 extends to one side of the body member 12 and forms the means by which the nock 10 can be attached to a tubular arrow shaft 16 made of metal such as aluminum or stainless steel or of plastic. The plug element 14 extends to one side of the body member 12 and coaxially therewith. The end is beveled at 18 to permit insertion in the shaft 16 and the outer surface is provided with a plurality of uniformly spaced grooves 20. The grooves 20 are provided to accept adhesive to insure that there is an adhesive bond between the interior of the arrow shaft and the nock 10.

The body member 12 forms an annular shoulder 21 surrounding the plug element 14 so that upon insertion into a tubular arrow shaft 16, the annular shoulder 21 helps to maintain the nock 10 in precise alignment with the axis of the arrow shaft 16.

A grip portion 22 extends from the body member 12 and includes a flattened portion 24 which merges with the body member 20 by way of opposed, tapered or inclined surfaces 26.

The free end of the flattened portion 24 is formed with a notch 28 which accepts a bow string (not shown) in the usual and conventional manner. Adjacent to the notch 28 are opposed upper and lower pad portions 30 and 32 respectively. The pad portions are elevated slightly above the surfaces of the flattened portion 24 and project to one side of the flattened portion 24 and to a side opposite to the side of the arrow which will rest against the bow. As viewed in FIG. 1, the upper edge of the nock is the portion intended to be closest to the bow and the lower edge from which the pad portions 30 and 32 project is the edge remote from the bow.

The pad portions 30 and 32 are provided with a textured surface which in the illustrated embodiment of the invention has a general saw tooth configuration, although it will be understood that various textured surfaces can be formed.

Referring to FIG. 1, the flattened portion 24 is reduced in cross sectional area at one side of the axis as indicated at surface 30 to provide a smooth surface and reduced area on the side opposite to the pad portion 30 and 32. This reduces the possibility of contact of the nock 10 with the finger tips of the archer upon release of an arrow.

Opposite to the reduced surface area 34 is a cavity 36 which serves the purpose of axially balancing the nock 10 due to any unbalance that may be caused by the reduced surface 34 and the offset pad portions 30 and 32.

The nock 10 preferably is molded of plastic materials and can be made in a variety of sizes to accommodate a tubular arrow shaft.

In use, a right handed archer places his index finger on the top pad 30 and the middle finger on the bottom pad 32 forward of the notch 28. The pads 30 and 32 which are slightly to one side of the nock are positioned away from the side of the bow with which the arrow is being used. The fingers can be slightly forward of the notch 28 so that when the fingers grip the top and bottom of the nock 10, the nock itself can be used to transmit force to the bow string during the usual draw of the arrow towards a release position. This minimizes the load of the bow string on the tips of the fingers which often can become uncomfortable and can affect accuracy.

Prior to release of an arrow with the nock 10 of the present invention, the hand is positioned to one side of the arrow opposite to the friction pads 30 and 32. Assuming that proper aim has been taken and the archer is ready to release the arrow, the index finger and middle finger are straightened. In so doing, the opposed tapered or ramp portions 26 engage the tips of the fingers causing the index and middle finger to spread slightly to lift away from the friction surfaces or pads 30 and 32 to insure clearance of the fingers with the nock 10. Furthermore, the reduced smooth surface area 30 moves past the tips of the fingers without engaging them to further reduce friction and improve accuracy.

An arrow nock has been provided which facilitates accurate mounting on the shaft of an arrow and has a grip portion which is so formed that movement of the index and middle finger of an archer relative to the nock minimizes contact with the finger tips to facilitate accuracy. Moreover the grip portion is so formed that friction areas enable an archer to use the arrow nock to transfer the portion of the load during the draw of the bow string through the nock as opposed to directly to the finger tips.

The embodiments of the invention in which an exclusive property or privilege is claimed are defined as follows:

1. An arrow nock comprising: a cylindrical body member, means for attaching said nock to an arrow shaft extending in one direction from said body member, a grip portion extending axially in the opposite direction from said shaft, said grip including a flattened portion symmetrical with the axis of said body member, a notch at the end of said grip portion to receive a bow string, pad portions disposed on the top and bottom of said flattened portion and adjacent said notch for engagement between the index and middle finger of an archer drawing a bow string, said pad portions being elevated above said flattened portion to afford clearance from the nock upon release of a drawn bow string.

2. The arrow nock of claim 1 wherein said means for attaching said nock to an arrow shaft comprises a plug shaft extending axially of said body member for insertion in a tubular arrow shaft.

3. The arrow nock of claim 2 wherein said shaft has longitudinally extending grooves to receive adhesive when said plug shaft is seated in an arrow shaft.

4. The arrow nock of claim 1 wherein said cylindrical body member is the same diameter as an arrow shaft to provide a continuous surface between said nock and arrow shaft.

5. The arrow nock of claim 1 wherein a tapered portion is provided between said cylindrical body member and said grip portion to engage the index and middle finger of an archer and gradually force the fingers apart upon release of said nock.

6. The arrow nock of claim 1 wherein said pad portions is textured to facilitate gripping the nock during drawing of the bow string.

7. An arrow nock as set forth in claim 1 wherein said pad portions are disposed to one side of the axis of said cylindrical body.

8. The arrow nock of claim 1 wherein said flattened portion is reduced at one side of said nock closest to the hand of an archer to afford clearance upon release of a drawn bow string.

9. An arrow nock as set forth in claim 1 in which said pad portions are disposed to one side of the axis of said cylindrical body member and wherein a recess is provided on the same side of said nock to reduce the mass and balance the nock relative to said axis.

10. An arrow nock comprising: a cylindrical body member having a diameter equal to the diameter of the arrow shaft, a plug element extending axially of said cylindrical body member for insertion into the end of a tubular arrow shaft and to hold said body member in abutting relationship to the end of an arrow shaft, a grip portion extending axially in the opposite direction from said shaft, said grip portion including a flattened portion having a thickness less than the diameter of said body member, said grip portion merging with said body member by a tapered portion, a notch at the end of said grip portion to receive a bow string, pad portions disposed on the top and bottom of said flattened portion and adjacent said notch, said pad portions being provided with friction surfaces for gripping between the index and middle finger of an archer drawing a bow string, said pad portions being elevated above said flattened portion and projecting to one side thereof, said fingers of an archer being gradually spread by said tapered portion upon release of the nock by an archer to clear said pad portions and the surfaces of said nock upon release of an arrow.

11. The arrow nock of claim 10 wherein said flattened portion is reduced along one side to form a smooth surface facing the hand of an archer to clear the finger tips upon release of an arrow.

* * * * *